US006108835A

United States Patent [19]

Hwang

[11] Patent Number: 6,108,835

[45] Date of Patent: Aug. 29, 2000

[54] CAMPING MAT ARRANGEMENT

[75] Inventor: Mike Hwang, Taipei, Taiwan

[73] Assignee: Goodway Corporation, China

[21] Appl. No.: 09/338,082

[22] Filed: Jun. 23, 1999

[51] Int. Cl.[7] ..... A47C 27/18; A47C 27/15; A47C 27/08

[52] U.S. Cl. ..... 5/420; 5/709; 5/700

[58] Field of Search ..... 5/709, 420, 700, 5/631, 736, 737, 655.3, 655.9, 656, 706

[56] References Cited

U.S. PATENT DOCUMENTS

| | | | |
|---|---|---|---|
| 3,016,317 | 1/1962 | Brunner | 5/420 |
| 3,798,686 | 3/1974 | Gaiser | 5/709 |
| 3,872,525 | 3/1975 | Lea et al. | 5/709 |
| 4,809,374 | 3/1989 | Saviez | 5/420 |
| 5,452,487 | 9/1995 | Leggett | 5/420 |
| 5,675,855 | 10/1997 | Culp | 5/709 |

*Primary Examiner*—Alexander Grosz
*Attorney, Agent, or Firm*—Don Finkelstein

[57] ABSTRACT

A camping mat in which the upper surface has a plurality of air insulating chambers to provide a reduction in body heat loss of the user. The mat may be configured as either a sleeping mat or a camping chair, or combination thereof, and may be of the self-inflating type with open-cell foam inside a waterproof and airtight envelope. Two pads of flexible foam are in the envelope and the upper pad has a plurality of pad cavities or pad apertures which, upon the assembly of the mat, cause the formation of the air insulating chambers.

15 Claims, 3 Drawing Sheets

FIG. 2
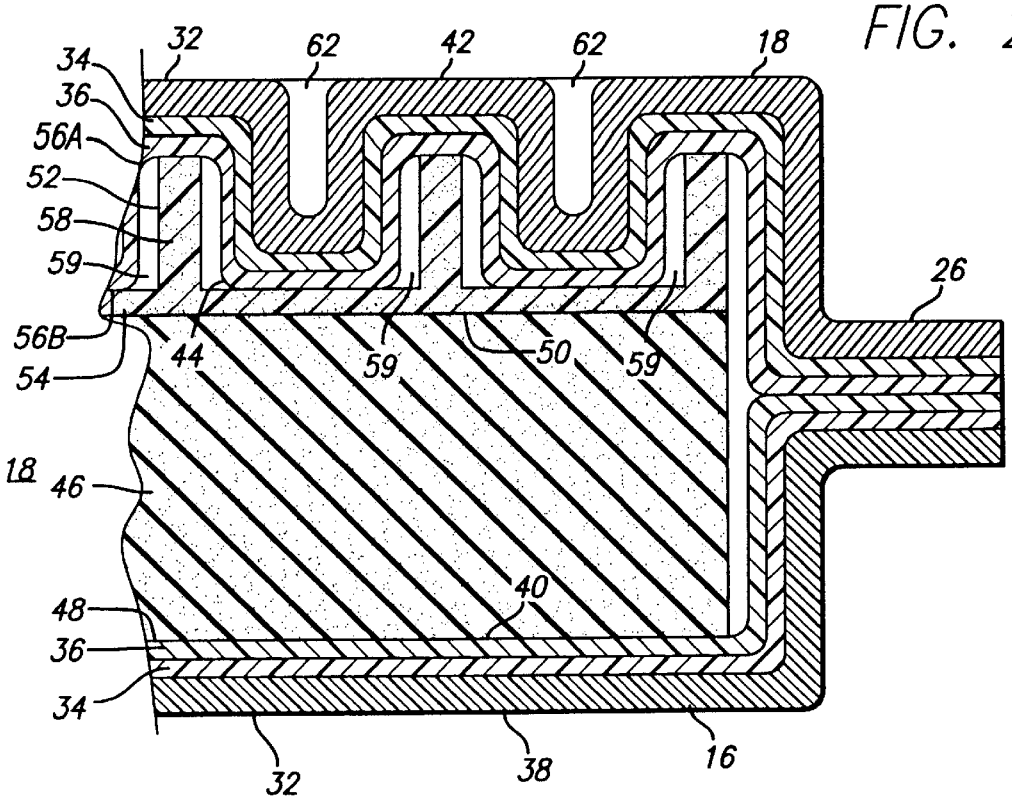
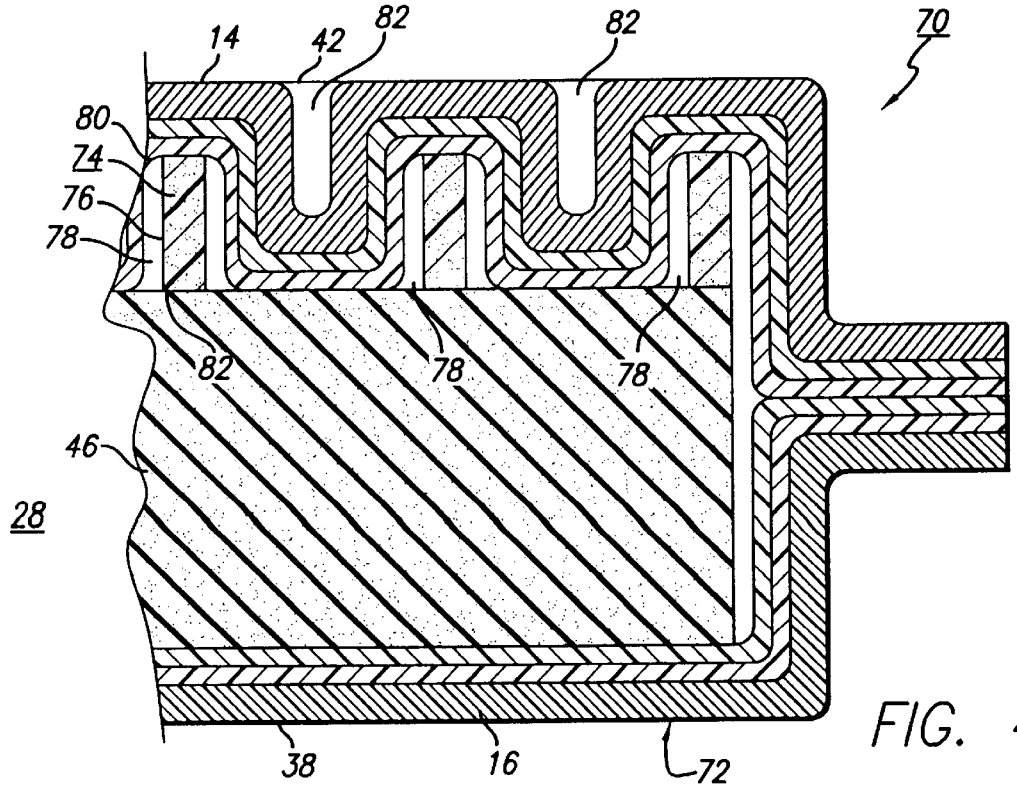
FIG. 4

CAMPING MAT ARRANGEMENT

BACKGROUND OF THE INVENTION

1. Field of the Invention

This invention relates to the camping mat art and more particularly to an improved mat configuration which may be advantageously utilized in a camping sleeping mat, in a camping seating arrangement mat, in a combined camping sleeping mat/seating arrangement and the like as particularly useful in back-packing, hiking, mountain climbing and other activities wherein a person is to sleep or sit on the ground or on structures outdoors or indoors and where both comfort and insulation are desired.

2. Description of the Prior Art

Many types of sleeping pads or mats as well as many types of seating arrangements for use by back-packers, hikers, mountain climbers and others engaged in outdoor activities have been made available to the persons engaged in such activities. In these activities it is desired that the pad be as light weight as possible and still provide insulation of the person from the cold ground as well as a high degree of comfort for sleeping and/or seating. Such pads are preferred to be flexible so that they maybe rolled or folded into a compact configuration. In addition, seating at outdoor stadiums in many locals in the winter has been an activity in which various types of pads have been available to provide increased comfort and insulation while seated at such a stadium.

One type of pad heretofore available has been a type of self inflating pad or mat in which there is an upper and a lower sheet defining an outer envelope of an air tight material such as a plastic coated nylon and which has an open cell, flexible polyurethane foam pad in the envelope. The upper and lower sheets are bonded together at the peripheral edges thereof to define the envelope. An open-cell, flexible foam pad inside the envelope and an air valve was provided on the envelope to allow selectively ambient air, or forced aspiration from the user, to enter the cavity defined by the envelope in which the open-cell pad is located and inflate the open-cell foam pad. For the valve in the open position and to prevent air escaping from the envelope to regions external thereof in the closed position. The inner surface of the upper and lower sheets were bonded, for example by use of a thermoplastic layer on the inside surface of the upper and lower sheets, to the upper and lower surfaces of the foam pad. Such a mat or seat configuration could provide an insulating effect as well as a comfortable decise for use as either a mat or a seat. However, it has been found that in the use of such a camping mat or seat configuration, the pad did not provide as much insulating qualities as desired to preserve the body heat of the user and prevent the conduction of the body heat of the used to the ground. Further, the more or less planar configuration of such a sleeping pad or seating arrangement often resulted in slipping of the user thereon and, further, tended to prevent the molding of the pad to the configuration of the portions of the user's anatomy in contact with the pad.

On type of pad arrangement which combines the functions of both a sleeping mat and a seating arrangement is described in which a single unit may be conveniently utilized as either a camping mat for sleeping or a seating arrangement for sitting. Such a structure is described and claimed in U.S. Pat. No. 5,384,923. In one embodiment thereof there is described an air tight envelope comprised of an upper sheet and a lower sheet defining a pad accepting cavity therebetween. Two foam pads substantially coextensive with the upper and lower sheets are in the pad accepting cavity. In such an embodiment there is described that one of the pads is an open-cell foam and the other of the pads is a closed-cell foam. The open-cell foam pad has one-half the thickness of the single pad utilized in other embodiments and the same density as the open-cell foam pads utilized in other embodiments described therein. However, such configuration did not provide as much insulating quality for preserving the user's body heat or contour forming action in use nor increased friction to prevent the user from slipping when using the pad as often desired in many applications of use of the pad.

Thus there has long been a need for both a camping mat or pad and a seating arrangement in which the pad or seating arrangement not only increases the insulation effect to preserve the body heat of the user but also provides increased friction to decrease the slippage of the user thereon as well as forming a more body part contouring effect for increased comfort.

SUMMARY OF THE INVENTION

Accordingly, it is an object of the present invention to provide a camping pad which may be used as a sleeping pad a seating arrangement or a combination of the two which has an increased insulating characteristic to preserve the body heat of the user.

It is a further object of the present invention to provide an improved camping pad which decreases the slippage of the user thereon.

It is still a further object of the present invention to provide an improved camping pad which increases the contouring of the pad to the body part of the user in contact with the pad.

The above, and other objects of the present invention are achieved, according to a preferred embodiment of a camping mat for sleeping or a camping chair seating arrangement mat or a combined sleeping mat and camping chair as described in U.S. Pat. No. 5,384,923, by providing a flexible, airtight envelope body having an upper sheet and a substantially coextensive lower sheet defining a pad receiving cavity therebetween. Each of the upper sheet and the lower sheet have an inside surface and an outside surface. The mat has a pair of spaced apart remote end edges and a pair of spaced apart lateral edges. The pair of remote end edges and the pair of lateral edges define the peripheral edge of the mat and the upper sheet is bonded to the lower sheet throughout the extent of the peripheral edge to form the air tight pad receiving cavity. Each of the upper and lower sheets of the body member are preferably a multi-layer configuration with an outside layer of nylon and one or more layers of a thermoplastic or thermosetting coatings on the inside. Preferably the inner most layer is a thermoplastic layer so that bonding as required in the present invention may be readily achieved.

An air transfer valve is provided, in one embodiment of the present invention, on one of the upper and lower sheets. In another preferred embodiment of the present invention, the air valve is coupled to the body on the peripheral edge. The valve has an open position in which there is air flow communication between the pad receiving cavity and regions external the mat and a closed position in which the flow of air between the pad receiving cavity and the regions external the mat is prevented. In the open position, ambient air may flow into the pad to the extent that the pressure in the pad receiving cavity is less than the local atmospheric pressure. Alternatively, for the valve in the open position the user may inflate the pad receiving cavity by normal aspiration. When the pressure in the pad receiving cavity is at the value desired by the user, the valve may be closed to prevent any air flow into or out of the pad receiving cavity.

A first pad member is positioned in the pad receiving cavity and has a first preselected thickness which may be in the range of 1 inch to 2 inches. The first pad member is preferably an open-cell polyurethane foam and has a first preselected density which may be in the range of 1.4 to 1.7 pounds per cubic foot. The first pad is substantially coextensive with the upper sheet and the lower sheet of the body and extends from the pair of spaced apart end edges to the pair of spaced apart lateral edges. The first pad member has a first surface adjacent the inside surface of the lower sheet and a second surface spaced therefrom the thickness thereof. In preferred embodiments of the present invention, the inside surface of the lower sheet is bonded to the first surface of the first pad member substantially throughout the extent thereof.

According to the principles of the present invention, a second pad member is positioned in the pad receiving cavity and is substantially coextensive with the first pad member. The second pad member has a first surface adjacent the second surface of the first pad member. The second pad member has a second preselected thickness which is less than the first preselected thickness of the first pad member and has a second surface spaced from the first surface of the second pad member and the second surface of the second pad member is adjacent the inner surface of the upper sheet. In a preferred embodiment of the present invention, the second preselect thickness is in the range of ¼ inch to ½ inch. The second pad member has walls defining a plurality of pad apertures or pad cavities extending from the second surface toward the first surface thereof. The pad apertures or pad cavities may, if desired extend through the second pad member from the first surface to the second surface. Alternatively, the pad apertures or cavities may not go entirely through the second pad member. The plurality of pad apertures or cavities may have any desired geometrical configuration. In preferred embodiments of the present invention the geometrical shape may be a diamond shape. In other embodiments of the present invention the pad apertures or pad cavities may be any desired quadrilateral such as square, rectangular, trapezoid or the like. Further, the pad apertures or pad cavities may have straight edges defining the pad cavities or pad apertures or the edges of the pad apertures or pad cavities may be curved as desired in particular applications.

In those embodiments of the present invention wherein the pad cavities or pad apertures do not extend all the way through the second pad member but define a plurality of depressions, the inside surface of the upper sheet of the body is bonded to the second surface of the second pad member substantially throughout the extent thereof including the lowered portions thereof in the depressions. In those embodiments where the pad apertures of pad cavities extend through the second pad member, the inside surface of the upper sheet of the body is bonded to substantially all of the upper surface of the second pad member and to the second surface of the first pad member in the regions of the pad apertures or pad cavities. The inside surface of the upper sheet may also be bonded to the peripheral walls of the pad apertures or pad cavities. In all of the embodiments the pad apertures or pad cavities form correspondingly shaped depressions in the upper sheet of the body. The pad apertures or pad cavities may extend in a uniform array throughout the extent of the mat or may extend in any desired preselected pattern array. Further, the pad apertures or pad cavities may vary in shape throughout the extent of the mat and may be in different arrays in different portions of the mat.

In use, the mat is inflated to the desired internal pressure and the outside surface of the lower sheet of the body is placed upon the ground or other structure upon which it is to be supported. The user sits or lies upon the outside surface of the upper sheet of the body. In those portions of the mat which are in contact with the user there are a plurality of air pockets between the user and the outside surface of the upper sheet at each depression. Such air pockets act as insulating air gaps to preserve more of the body heat of the user. Further, the depressions make the outside surface of the upper sheet of the pad more resistant to slipping of the user thereon and also allows the mat to conform more closely to the contours of the user's body in contact with the mat than mats in which there are no depressions.

The dimensions of the pad apertures or pad cavities may be, for example in the embodiments wherein pad apertures or pad cavities are diamonds, on the order of two inches on each side and a long dimension on the order of three inches and a short dimension on the order of one and one half inches. The plurality of diamond shaped pad apertures or pad cavities may be spaced in a rectangular, spaced apart array of two inches on center. However, as noted above other shaped pad apertures or pad cavities may be utilized as may other arrays and other sizes thereof as may be desired.

When it is desired to transport the mat, the valve may be opened and the mat rolled up. As the mat is rolled up, the air in the pad cavity is forced out to regions external the mat and the first and second pad members are compressed. Therefore, in preferred embodiments of the present invention the first pad is preferably an open-cell foam while the second pad member is also preferably an open-cell foam. A closed-cell foam may be utilized for the second pad member as may be desired in particular applications. Alternatively, both the first and second pad members may be a closed-cell foam though in such an embodiment the mat will not be able to be rolled into as small a configuration as in the embodiments where an open-cell foam is used.

If desired, the lower surface of the upper layer may be bonded to the upper surface of the lower layer.

BRIEF DESCRIPTION OF THE DRAWING

The above and other embodiments of the present invention may more fully understood from the following detailed description taken together with the accompanying drawing wherein similar reference characters refer to similar element through out and in which:

FIG. 2 is a sectional view along the line 2—2 of FIG. 1;

DESCRIPTION OF THE PREFERRED EMBODIMENTS

Figure 1:
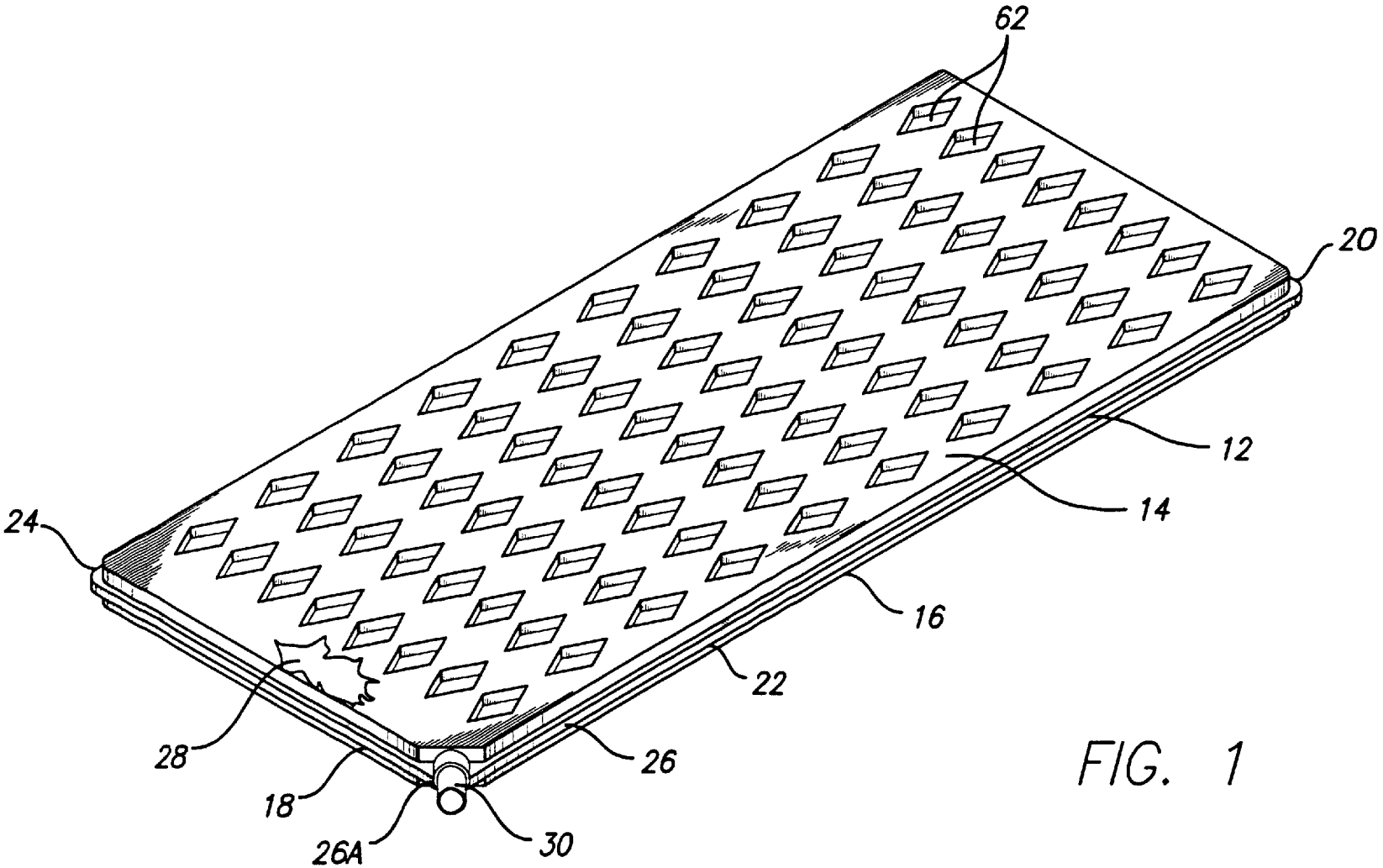
FIG. 1 is a perspective view of a preferred embodiment of the present invention.

Referring now to the drawing there is illustrated in FIGS. 1 through 3 a preferred embodiment generally designated 10 of a sleeping mat or seating arrangement mat according to the principles of the present invention. There is provided a flexible, airtight and preferably waterproof envelope body 12 having an upper sheet 14 and a lower sheet 16. The mat 12 has a pair of spaced apart remote end edges 18 and 20 and a pair of spaced apart lateral edges 22 and 24. For use as a sleeping mat, the length of the mat between the pair of remote end edges 18 and 20 may be on the order of six feet and the width of the mat between the pair of lateral edges may be on the order of 20 inches. However, larger or smaller sizes may be used as desired for particular applications. Similarly, for use as a camping chair mat, the length may be on the order of four feet and the width on the order of two feet. For such a camping chair mat there is preferably provided a fold line (not shown) intermediate the pair of remote ends 18 and 20, as taught, for example, in U.S. Pat. No. 5,384,923 to allow one portion to be positioned at 90° to the other portion. In such an embodiment, straps (not shown) may be included to detachably retain the camping chair mat in the chair position.

The pair of remote end edges 18 and 20 and the pair of lateral edges 22 and 24 define a peripheral edge 26 extending around the body 12 and the upper sheet 14 is bonded to the lower sheet 16 along the peripheral edge 26 to provide an airtight pad receiving cavity 28.

An air transfer valve 30 is provided, in this embodiment 10, at a corner 26 a of the peripheral edge 26. The air transfer valve 30 may, in other embodiments be coupled to either the upper sheet 14 or the lower sheet 16. The valve 30 has an open position in which there is air flow communication between the pad receiving cavity 28 and regions external the body 12 to allow air to flow into and out of the pad receiving cavity 28. In the open position, local atmospheric pressure air may flow into the pad receiving cavity 28 and then the valve may be closed to prevent air from leaving the pad receiving cavity 28. Alternatively, for the valve 30 in the open position the user of the mat may inflate the pad receiving cavity manually by normal aspiration by blowing into the valve 30 until the desired air pressure, which may be higher than the local air pressure, as encountered, for example in mountain climbing, in the pad receiving cavity 28 is achieved and the valve may then be closed.

Each of the upper sheet 14 and lower sheet 16 are preferably multi-layer sheets. The outer most layer 32 is preferably a waterproof nylon. The next layer is a thermosetting layer 34 and the inner most layer 36 is a thermoplastic layer in the preferred embodiments of the present invention. The thermoplastic layer provides the bonding as required in the body 12. Other arrangements of layers and other materials may also be utilized provided they are suitable for the function of providing the air tight cavity 28 and the required bonding. The lower sheet 16 has an outside surface 38 and an inside surface 40. Similarly, the upper sheet 18 has an outside surface 42 and an inside surface 44. The inside surfaces 40 and 44 are the thermoplastic layer surfaces in the embodiment 10.

A first pad member 46 is positioned in the pad receiving cavity 18 and the first pad member may be an open-cell, flexible polyurethane foam having a density on the order of 1.4 pounds per cubic foot to 1.7 pounds per cubic foot, though higher or lower values may be selected for particular applications. The first pad member 46 has a first surface 48 and a second surface 50. The first pad member extends substantially coextensively with the upper sheet 16 and lower sheet 14 between the remote end edges 18 and 20 and the lateral edges 22 and 24. The first surface 48 of first pad member 46 is bonded substantially throughout the extent thereof to the inside surface 40 of the lower sheet 16 by the thermoplastic layer 36. The thickness of the first pad member 46 between the firs surface 48 and second surface 50 is in the range of 1.5 inches to 2.0 inches in preferred embodiments of the present invention though greater or smaller thicknesses may be used as desired for particular applications.

According to the principles of the present invention, a second pad member 52 is also positioned in the pad receiving cavity 28 between the second surface 50 of the first pad member 46 and the inside surface 44 of the of the upper sheet 18. The second pad member 52 is substantially coextensive with the first pad member 46 and has a first surface 54 adjacent the second surface 50 of the first pad member 46 and a second surface 56. The thickness of the second pad member between the first surface 54 and second surface 56 is less than the thickness of the first pad member and may be on the order of ¼ inch to ½ inch. The second pad member may be fabricated from an open-cell polyurethane flexible foam and may have a density on the order of 1.4 pounds per cubic foot to 1.7 pounds per cubic foot.

The second pad member has walls 58 defining a plurality of pad apertures or pad cavities 59. In the embodiment 10, the pad cavities 59 extend from the second surface 56 towards the first surface 54 but do not extend through the entire thickness of the second pad member 52. The second surface 56 of the second pad member 52 is not planar but has the outer portions indicated at 56*a* and inner portions in the pad cavities as indicated at 56*b*. The inside surface 44 of the upper sheet 18 is bonded to the second surface 56 of the second pad member 52 on both the outer surface portions 56*a* and the inner surface portions 56*b* and may, if desired, also be bonded to the walls 58 of the second pad member 52. The depression of the upper sheet 14 into the pad cavities 59 provide a plurality of air insulating chambers 62 on the outside surface 42 of the upper sheet 18. The second pad member may also, if desired, have the first surface 54 thereof bonded to the second surface 50 of the first pad member 46.

As shown on FIG. 1, the air insulating chambers are diamond shaped and are in a rectilinear array. The diamond shape may be on the order of 3 inches in the long dimension and 1 inch in the short dimension and may be spaced about 2 inches on center. It will be appreciated that other dimensions may be utilized as desired for particular applications. Further, the array of air insulating chambers may not be a uniform rectilinear array as shown on FIG. 1, but may be in any desired array configurations as desired for particular applications.

Figure 3A:
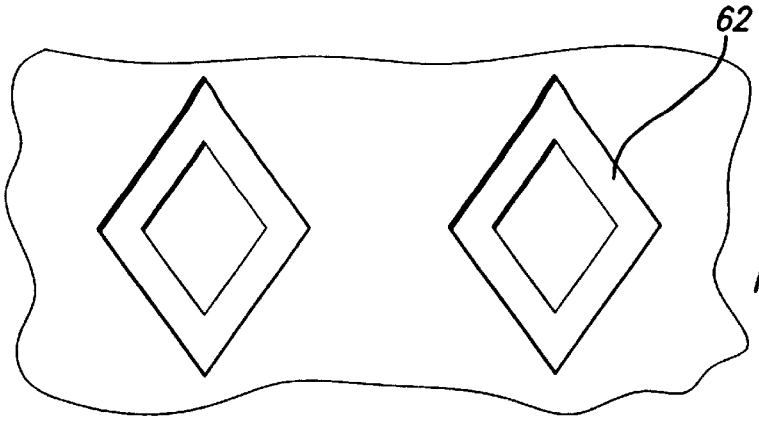
FIGS. 3A, 3B, 3C and 3D illustrate various geometric shapes useful for the pad apertures or pad cavities of the present invention; and, FIG. 4 is a sectional view similar to FIG. 2 of another embodiment of the present invention.
Figure 3B:
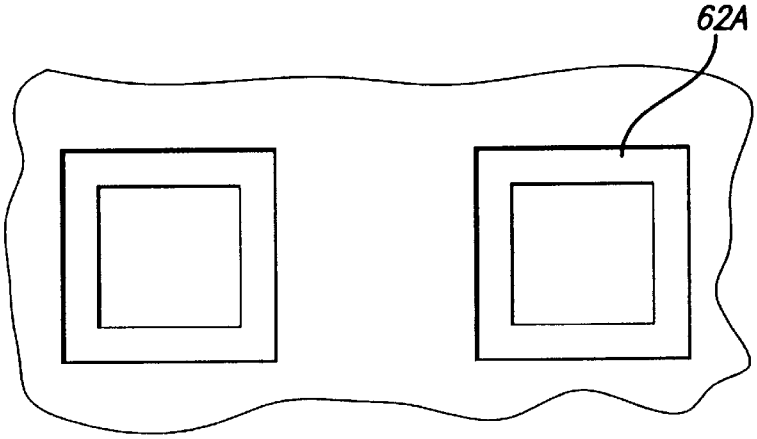
Figure 3C:
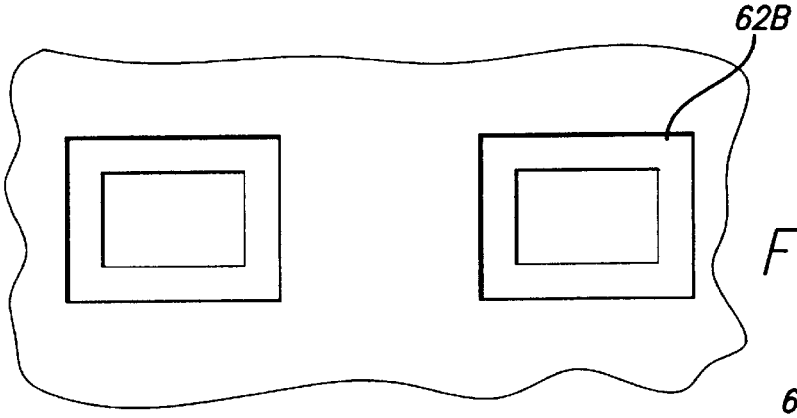
Figure 3D:
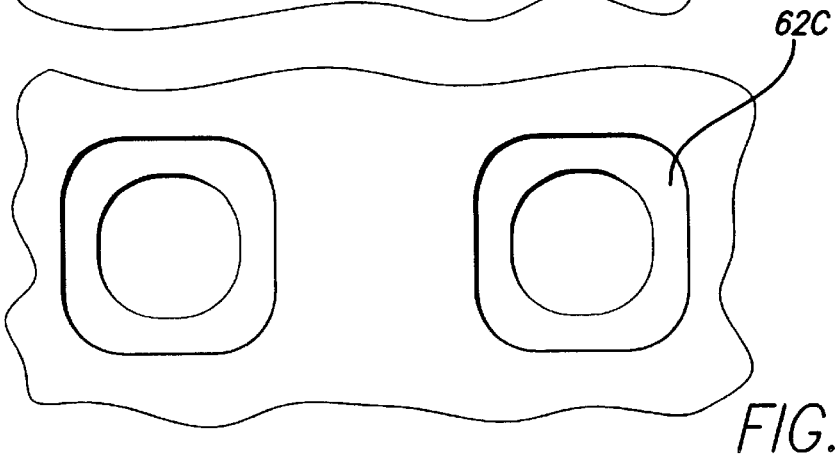

The pad cavities and air insulating chambers may be of any desired geometrical configuration. FIG. 3A shows the diamond shaped air insulating chambers 62. FIG. 3B and FIG. 3C show quadrilateral air insulating chambers in which 62*a* is square and 62*b* is rectangular. FIG. 3D shows air insulating chambers 62*c* in which the walls are curved The pad cavities 59 may be provided by several manufacturing methods. In one method, the pad cavities are cut from the second pad before it is installed in the body 12. In another method, the heated platen that is used to provided the heat and pressure for the bonding of the thermoplastic layers may have the male counterparts to the pad cavities thereon so that upon pressing the platen onto the upper sheet the second pad member is formed into the pattern of the pad cavities.

FIG. 4 illustrates an embodiment 70 which is similar to the embodiment 10 and has a body 72 comprised of an upper sheet 14 and a lower sheet 16 defining an air tight cavity 28 and a first pad member 46 is positioned in the cavity 28.

The second pad member 74 is configured to have walls 76 defining pad apertures 78 which extend from the second surface 80 all the way through the second pad member 76 to the first surface 82. Upon assembly of the body 72, the pad apertures 78 cause the formation of the air insulating chambers 82. The structure of the embodiment 70 is otherwise similar to the structure of the embodiment 10 described above.

In use, the mat is inflated as described above and the outside surface 38 of the body 12 or 72 is placed upon the ground or other structure upon which it is to be supported. The user then sits or reclines on the outside surface 42 of the upper sheet 14. The insulating qualities of the air insulating chambers 62 or 82 where in contact with the user further insulate and reduce the loss of body heat from the user. It has been found that the roughened texture of the outside surface 42 of the body 12 or 72 tense to reduce the slipping of the user thereon and that the air insulating chambers also aid in the mat to conform more closely to those portions of the user in contact therewith.

This concludes the description of the preferred embodiments of the present invention and set forth the best mode contemplated by the inventor for carrying out the invention herein. Those skilled in the art may find many variations and adaptations of the invention herein and the appended claims are intended to cover all such variations and adaptations falling within the true scope and spirit of the invention.

I claim:

1. An improved camping mat or camping chair comprising, in combination:

a flexible, substantially air tight body having an upper sheet and a substantially coextensive lower sheet, and each of said upper sheet and said lower sheet having an inside surface and an outside surface and peripheral edges sealed together to define a substantially air tight pad receiving cavity between said inside surfaces thereof;

an air transfer valve coupled to one of said upper sheet and said lower sheet for selectively providing air flow communication between said pad receiving cavity and regions external said body member in an open position and selectively blocking the flow of air into said pad receiving cavity from regions external said cavity in a closed position;

a first pad member in said pad receiving cavity and substantially coextensive with said upper sheet and said lower sheet, and said first pad member comprised of an open cell foam having a first preselected thickness and having a first surface adjacent to and bonded to said inside surface of said lower sheet substantially throughout the extent thereof, and a second surface spaced from said first surface;

a second pad member in said pad receiving cavity intermediate said second surface of said first pad member and said inside surface of said upper sheet and said second pad member having a first surface adjacent said second surface of said first pad member and a second surface adjacent said inside surface of said upper sheet and bonded thereto, in at least portions thereof said second pad member having a second preselected thickness less than said first preselected thickness of said first pad member and having walls defining a plurality of pad cavities extending from said second surface toward said first surface, and said upper sheet extending into said pad cavities to define a plurality of air insulating chambers on said outer surface of said upper sheet.

2. The arrangement defined in claim 1 wherein:

said inside surface of said upper sheet is bonded to said second surface of said second pad member in said pad cavities.

3. The arrangement defined in claim 1 wherein:

said pad cavities in said second pad member extend through said second pad member from said first surface to said second surface thereof.

4. The arrangement defined in claim 3 wherein:

said upper sheet is bonded to at least a portion of said second surface of said first pad member in regions of said pad cavities.

5. The arrangement defined in claim 3 wherein:

said first pad member is an open cell polyurethane foam and has a density in the range of 1.4 to 1.7 pounds per cubic foot and said first preselected thickness is on the order of 1.5 inches;

said second pad member is an open cell polyurethane foam and has a density in the range of 1.4 to 1.7 pounds per cubic foot and said second preselected thickness is on the order of 0.5 inches; and, said upper sheet is bonded to at least a portion of said second surface of said first pad member in regions of said pad cavities.

6. The arrangement defined in claim 3 wherein:

said first pad member is an open cell polyurethane foam and has a density in the range of 1.4 to 1.7 pounds per cubic foot and said first preselected thickness is on the order of 1.5 inches;

said second pad member is an open cell polyurethane foam and has a density in the range of 1.4 to 1.7 pounds per cubic foot and said second preselected thickness is on the order of 0.5 inches; and, said upper sheet is bonded to at least a portion of said second surface of said first pad member in regions of said pad cavities; and, said upper sheet is a multi-layer flexible fabric comprised of a nylon layer defining said outside surface and at least one layer selected from the class consisting of thermoplastic and thermosetting layer defining the inner surface thereof; and, said lower sheet is a multi-layer flexible fabric comprised of a nylon layer defining said outside surface and at least one layer selected from the class consisting of thermoplastic and thermosetting layer defining the inner surface thereof.

7. The arrangement defined in claim 1 wherein:

said first pad member is on the order of three times as thick as said second pad member.

8. The arrangement defined in claim 7 wherein:

said first pad member is an open cell polyurethane foam and has a density in the range of 1.4 to 1.7 pounds per cubic foot.

9. The arrangement defined in claim 8 wherein:

said second pad member is an open cell polyurethane foam and has a density in the range of 1.4 to 1.7 pounds per cubic foot.

10. The arrangement defined in claim 1 wherein:

said first pad member is an open cell polyurethane foam and has a density in the range of 1.4 to 1.7 pounds per cubic foot and said first preselected thickness is on the order of 1.5 inches;

said second pad member is an open cell polyurethane foam and has a density in the range of 1.4 to 1.7 pounds per cubic foot and said second preselected thickness is on the order of 0.5 inches.

11. The arrangement defined in claim 1 wherein:

said first pad member is an open cell polyurethane foam and has a density in the range of 1.4 to 1.7 pounds per cubic foot and said first preselected thickness is on the order of 1.5 inches;

said second pad member is an open cell polyurethane foam and has a density in the range of 1.4 to 1.7 pounds per cubic foot and said second preselected thickness is on the order of 0.5 inches;

said upper sheet is a multi-layer flexible fabric comprised of a nylon layer defining said outside surface and at least one layer selected from the class consisting of thermoplastic and thermosetting layer defining the inner surface thereof; and, said lower sheet is a multi-layer flexible fabric comprised of a nylon layer defining said outside surface and at least one layer selected from the class consisting of thermoplastic and thermosetting layer defining the inner surface thereof.

12. The arrangement defined in claim 1 wherein:

said pad cavities are generally diamond shaped.

13. The arrangement defined in claim 1 wherein:

said pad cavities are generally quadrilateral shaped.

14. The arrangement defined in claim 13 wherein: said pad cavities are generally rectangular shaped.

15. The arrangement defined in claim 13 wherein:

said pad cavities are generally square shaped.

* * * * *